United States Patent [19]

Pelz

[11] Patent Number: 4,793,393

[45] Date of Patent: Dec. 27, 1988

[54] PROCESS FOR THE PRODUCTION OF A VENEER WORKPIECE WITH CUTOUT, AS WELL AS PRESSURE PUNCHING TOOL FOR PERFORMING THE SAME

[76] Inventor: Peter Pelz, Dieselweg 10, 8192 Geretsried 2/Obb., Fed. Rep. of Germany

[21] Appl. No.: 108,017

[22] Filed: Oct. 14, 1987

[30] Foreign Application Priority Data

Oct. 28, 1986 [DE] Fed. Rep. of Germany ..... 3636587

[51] Int. Cl.[4] ..... B27G 11/00

[52] U.S. Cl. ..... 144/350; 83/681; 144/345; 156/251; 156/261

[58] Field of Search ..... 83/102, 171, 684, 691; 144/345, 330, 348, 350; 156/250, 251, 261, 518, 530; 428/16, 117

[56] References Cited

U.S. PATENT DOCUMENTS

| | | | |
|---|---|---|---|
| 3,287,195 | 11/1966 | Piazze | 156/251 |
| 3,713,944 | 1/1973 | Dennis et al. | 156/261 |
| 3,990,142 | 11/1976 | Weglin | 156/261 |
| 4,320,572 | 3/1982 | Brower | 156/261 |

*Primary Examiner*—W. Donald Bray

[57] ABSTRACT

Process for producing a veneer workpiece in the form of a flat plate or the like with a preferably, at least partly wooden base layer, optionally in the form of a base veneer constituted by several individual layers, a face veneer having at least one wooden face veneer layer and a cutout passing through the base layer and the face veneer, in which the base layer and the face veneer are preferably glued together by means of a synthetic resin adhesive, which produces the cutout passing through the base layer and the face veneer and finally the circumferential wall or walls thereof are covered with face veneer material, characterized in that the gluing of the base layer and the face veneer to form a solid workpiece, the formation of the cutout or cutouts and the covering of the circumferential wall thereof with the face veneer in a single pressure punching process, the face veneer layer being pressed through from the surface of the veneer workpiece into the cutout or cutouts, while covering the circumferential wall of the latter up to the transition of the circumferential wall with the cutout edge defining the opposite face of the veneer workpiece.

12 Claims, 1 Drawing Sheet

PROCESS FOR THE PRODUCTION OF A VENEER WORKPIECE WITH CUTOUT, AS WELL AS PRESSURE PUNCHING TOOL FOR PERFORMING THE SAME

The invention relates to a process for producing a veneer workpiece in the form of a flat plate or the like with a preferably, at least partly wooden base layer, optionally in the form of a base veneer constituted by several individual layers, a face veneer having at least one wooden face veneer layer and a cutout passing through the base layer and the face veneer, in which the base layer and the face veneer are preferably glued together by means of a synthetic resin adhesive, which produces the cutout passing through the base layer and the face veneer and finally the circumferential wall or walls thereof are covered with face veneer material.

DESCRIPTION OF THE PRIOR ART

Hitherto furniture or other wooden parts with cutouts, whose edges are provided with the material of the face veneer of the particular veneer workpiece has taken place in the following way. The workpiece is veneered with the face veneer of the corresponding wood type, the cutout is milled out and the edges of the cutout are glued with face veneer strips, whose width is somewhat greater than the thickness of the workpiece. The lateral edges of the glued face veneer stips covering the circumferential wall of the particular cutout project over the workpiece surface to either side after gluing and must be cut away in a separate operation and then the cutout edges must be cleaned. The following operations are then necessary. The workpiece must be produced by gluing from face veneer and the corresponding base or central layer veneers, followed by the milling of the cutout, the sharp filing out of the cutout corners because milled corners always have rounded portions, as a function of the milling cutter diameter, with a varying radius of curvature, cutting to precise size the face veneer strips, gluing the latter onto the circumferential wall of the cutout, deburring the face veneer strip edges projecting over the lateral faces and finally cleaning or grinding the glued joints. As a result of the aforementioned steps, the known process of the aforementioned type is very labour intensive and the esthetic effect of the cutouts produced in this way and whose circumferential wall is covered with face veneer material is not entirely satisfactory.

Therefore the problem of the present invention is to provide a process and a pressure punching tool of the aforementioned type, in which the labour effort and expenditure are much lower than hitherto, the procedure is inexpensive and the esthetic appearance of the veneer workpiece produced is completely satisfactory.

SUMMARY OF THE INVENTION

According to the invention this problem is solved in the case of a process of the aforementioned type in that the gluing of the base layer and the face veneer to form a solid workpiece, the formation of the cutout or cutouts and the covering of the circumferential wall thereof with the face veneer is accomplished in a single pressure punching process, the face veneer layer being pressed through from the surface of the veneer workpiece into the cutout or cutouts, whilst covering the circumferential wall of the latter up to the transition of the circumferential wall with the cutout edge defining the opposite face of the veneer workpiece.

The pressure punching process can be performed at a temperature of 140° C.

A phenolic resin film can be used for gluing the veneer layers.

In a special embodiment of the claimed process it is proposed that synthetic resin glue is used for gluing the veneer layers.

It is also possible to proceed in such a way that the pressing process is performed with a pressing pressure of approximately 10 kp/cm$^2$.

The inventively proposed pressure punching tool for performing the claimed process is characterized by a punching tool, which is provided with at least one cutting edge with associated displacement surface and associated shaping surface for producing the cutout and a substantially planar opposite tool in the form of a substantially planar plate.

The punching tool and/or the opposite tool are preferably constructed so as to be heatable.

The opposite tool, as the lower tool, is positioned in a substantially horizontal, stationary manner and the punching tool, as the upper tool, is vertically movable with respect thereto.

A further embodiment of the inventive pressure punching tool is characterized by at least one spacing face provided on the punching tool for preventing contacting between the cutting edge or edges of the punching tool and the opposite tool surface.

The punching tool can be provided with a shaping edge close to the outer border of the veneer workpiece to be produced. In addition, the shaping edge is preferably rounded in the case of the pressure punching tool according to the invention.

Finally, according to another embodiment of the invention a pressure punching tool is proposed, which is characterized in that the distance from the shaping edge to the surface of the opposite tool when the pressure punching tool is closed is greater than the distance of the cutting edge or edges from the surface.

Unlike in the prior art, the invention makes it possible to produced veneer workpieces with cutouts, whose circumferential wall is veneered, in which the gluing of the workpiece from individual layers and the cutting of the cutout with the following veneering of the circumferential cutout wall takes place in a single pressure punching process. Instead of the seven operations necessary in the hitherto known procedure, only a single pressure punching process is required. The invention offers numerous advantages. The inventive process is simple to perform, in that only a single operation is required, the passage time through the production system is consequently very short, in a single operation a clean veneer workpiece is provided requiring no subsequent working, the inventive procedure is material-saving, because there is no need for face veneer strips as edge veneers and no glue for gluing down the same, the inventive process is very labour saving, in that in place of the seven operations of the prior art there is a single combined pressure punching operation, as stated hereinbefore. The veneer workpiece according to the invention can be inexpensively produced, because the wage costs and expenses are low. In addition, the inventive process economizes on capital expenditure and space, in that it only requires one workplace with a hydraulic press for the pressure punching tool. Finally, the introduction of fixing parts can be integrated into the pressure punching process, e.g. on the flat rear of the veneer workpiece facing the opposite tool, e.g. according to the teaching of German Utility Model No. 78 23 688.

In the case of workpieces with a limited thickness, e.g. up to 5 mm, such as are e.g. used as bordering for scales on the front of equipment, using an inventive pressure punching process during the production of the veneer workpiece from its layers simultaneously with the pressing and punching of the cutout the face veneer of the elevation face can be drawn down into the depth of the cutout up to the boundary edge with the rear face, so that the circumferential wall of the cutout is covered or lined with a face veneer and the latter, as a result of the displacement of the veneer layers in the lower part of the cutout edge, is given a sharply formed cutout edge. Thus, there is no need for the otherwise necessary cleaning work at this point. In addition, there is no need for all the work connected with the face veneer strips in the prior art, the actual strips being eliminated, including the glue necessary for gluing down the same, so that the inventive procedure involves low labour costs and also material costs.

In the case of cambered parts, the underside of the veneer workpiece to be produced is always flat through the pressing onto the surface of the lower tool, so that the veneer workpiece can be bonded without further preliminary work, such as the milling of a bearing surface. In the case of plain milling, such as has hitherto been required, the veneer workpieces can easily warp, because the counterveneers are partly destroyed and one-sided tensile forces can occur.

The greater the radius of curvature of the circumferential wall of the cutout the easier it is possible to perform pressure punching according to the invention and the drawing of the face veneer onto the cutout edges, because the expandability of the wood from which the face veneer is made is relatively low both along and at right angles to the wood fibre direction. However, the invention is able to satisfy the requirement of obtaining sharp cutout edges, because circular cutout edges can cover parts of any tables, scales and the like to be bordered, because the inventive process very economically permits the technically satisfactory production of sharp cutout edges, so that the esthetic demands on cutouts in surfaces can be much more satisfactorily fulfilled than was the case in the prior art.

BRIEF DESCRIPTION OF THE DRAWINGS

Further features and advantages of the invention can be gathered from the following description, which explains in detail embodiments by means of the diagrammatic drawings, wherein show.

DESCRIPTION OF THE PREFERRED EMBODIMENTS

Figure 1:
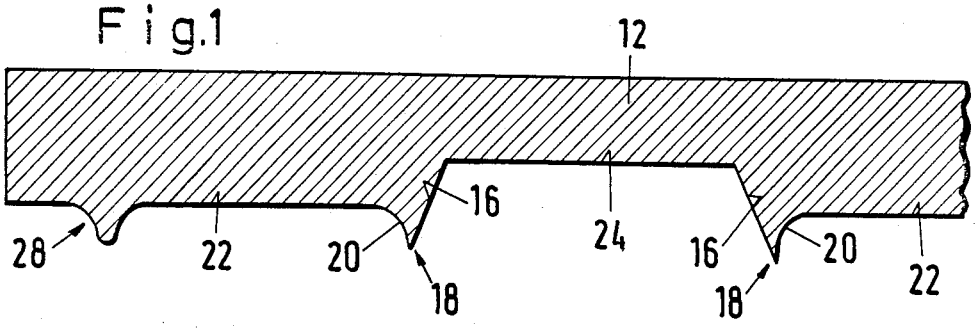
FIG. 1 A punching tool of an apparatus according to the invention, constructed as the upper tool, in section at right angles to the plane of the veneer workpiece to be produced.
Figure 2:
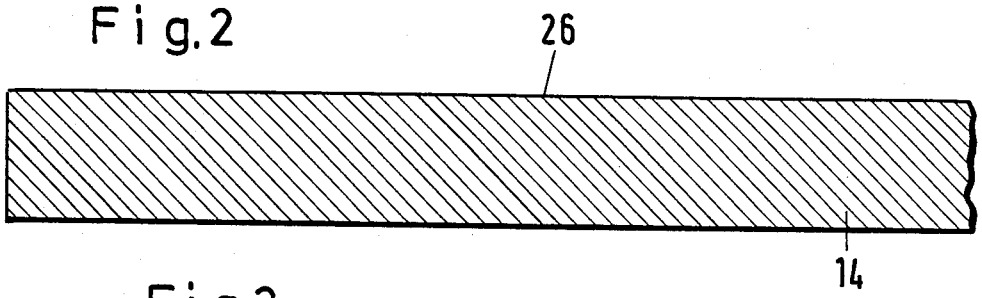
FIG. 2 In section corresponding to FIG. 1 an opposite tool of an apparatus according to the invention constructed as the lower tool.

As can be gathered from FIG. 1, the punching tool 12 shown therein, constituting the upper tool of the pressure punching tool forming the apparatus according to the invention, has on its lower surface, at the bottom in FIG. 1, an opposite tool 14, constructed as the lower tool and shown in FIG. 2, a conical surface-like displacement surface 16, which on its side facing the opposite tool 14 ends in a cutting edge 18, which is circular in the represented embodiment. From cutting edge 18 rises a curved shaping surface 20 comprising an approximately 90° curvature to a pressing or pressure surface 22, which is substantially parallel to the surface of the opposite tool 14. Within the area of the cutout to be produced in the veneer workpiece to be made surrounded by the cutting edge 18 is provided a deflection surface 24 set back from the pressure surface 22. FIG. 2 also shows that the surface 26 of opposite tool 14 facing punching tool 12 is flat or planar. Near to the left hand edge of punching tool 12, FIG. 1 also shows a shaping edge 28 with rounded faces, which on moving together the punching tool 12 and opposite tool 14 does not engage on surface 26 of punching tool 14, so that the drawing of veneer material in the direction of the cutout to be produced is not impeded.

Figure 3:
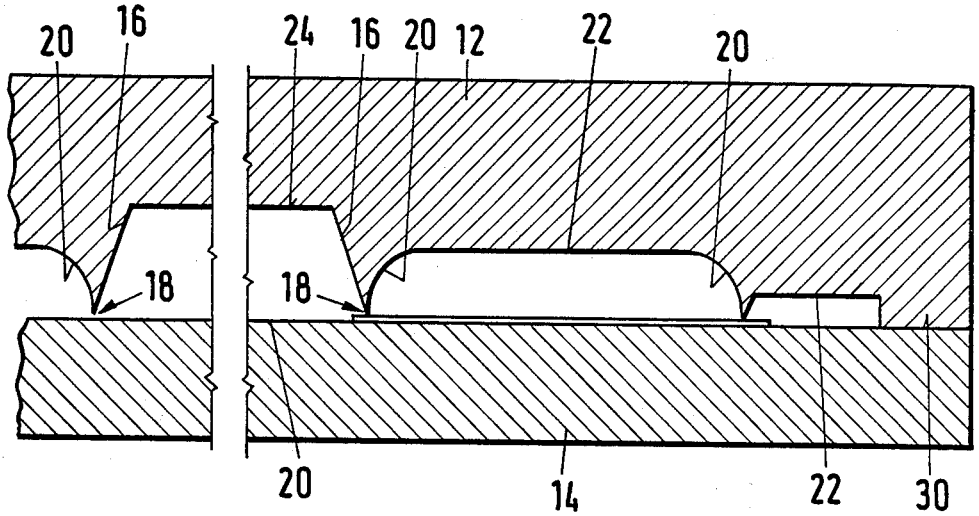
FIG. 3 On a larger scale the punching and opposite tool in section corresponding to FIGS. 1 and 2 with a detail of the shaping and cutting points.

In the embodiment according to FIG. 3, the punching tool 12 has a plurality of cutting edges 18, etc. for producing several cutouts. FIG. 3 also shows that the punching tool 12 is provided with a spacing surface 30, which on moving together the punching tool 12 and opposite tool 14 engages on surface 26 of punching tool 14 and prevents contacting between the cutting edges 18 of punching tool 12 and surface 26 of opposite tool 14, which could cause damage. The distance between the cutting edges 18 and surface 26 of opposite tool 14 when spacing surface 30 engages on surface 26 is only a few hundredths of a millimeter.

Figure 4:
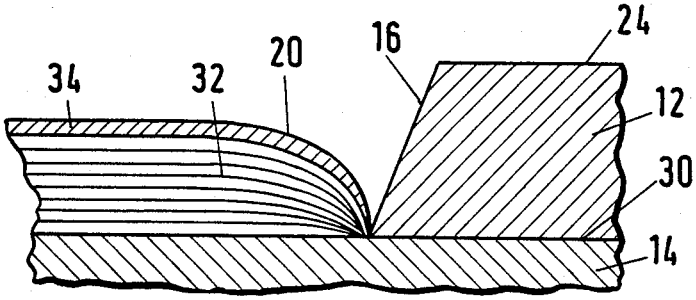
FIG. 4 A larger-scale sectional representation, corresponding to FIGS. 1 to 3, of the cutting and displacement process when using the punching tool according to FIGS. 1 to 3.

FIG. 4 shows the way in which base veneer layers 32 and a face veneer layer 34 of the veneer workpiece indicated in broken line form are deformed on moving together the punching tool 12 and opposite tool 14, the face veneer layer 34 covering the entire circumferential wall of the cutout produced and extending up to the planar back surface of the veneer workpiece to be produced and which faces the opposite tool 14.

The above-described apparatus functions in the following way in performing the inventive process for producing the inventive veneer workpiece. The upper tool, i.e. punching tool 12, is used for shaping and cutting and has the cut and squeezing edges in the form of cutting edges 18 for removing the waste product filling the cutout and the displacement of the material at the cutting edges. The outer border edge of the punching tool 12 also has the shaping edge 28, which optionally makes it possible to shape a rounded outer edge at this point. As has already been stated, when the pressure punching tool is in the closed state, shaping edge 28 does not extend up to the surface 26 of opposite tool 14 and does not have on its side facing surface 26 sharp cut faces and instead shaping edge 28 is rounded, so that the face veneer layer 34 of the veneer workpiece does not impede the tensile stresses occuring during shaping in the direction of the cutting edges 18.

Due to the fact that the spacing surface 30 has such a distance from the surface 26 of opposite tool 14 that the cutting edges 18 of punching tool 12 move to within a few hundredths of a millimeter of the surface 26 of opposite tool 14 on closing the pressure punching tool, it is ensured that the cutting edges 18 separate the material of veneer layers 32 or 34, which form the cutout waste, to such an extend that the waste piece, drops downwards and a sharp boundary edge is formed on the inner border of the cutout produced.

Both parts of the pressure punching tool, i.e. both the punching tool 12 and the opposite tool 14 are heated and in the preferably provided procedure using a phenolic resin glue film the temperature is approximately 140° C. At this temperature the phenolic resin passes into a liquid phase, so that the slidability of the individual layers required during shaping and distorting the face veneer layer 34 and in part the base veneer layers 32 is achieved. The necessary pressing pressure adequate for bonding the individual layers, the cutting pressure and the displacement pressures required on the cut edge of the cutout is preferably approximately 8 to 10 kp/cm$^2$.

The inventive process is a combined gluing and pressure punching process. The following procedure is adopted. As the workpiece comprises individual veneer layers, firstly the layer system constituted by the base veneer layers 32 and face veneer layer 34 is brought together and placed on the surface 26 of opposite tool 14. The pressure punching process is now started, in that the upper punching tool 12 passes onto the lower opposite tool 14. On moving down, cutting edge 18 removes the waste piece from the cutout and presses with the shaping surfaces 20 and displacement surfaces 16 the workpiece edges to be shaped in a downwards direction. This represents the start of the displacement process against the workpiece material on the cut edges of the workpiece and this increases as the cutting edges 18 of punching tool 12 approach the surface 20, serving as a bearing surface, of the lower tool 14. This deformation and displacement pressure on the cutout edges is accompanied by a pulling action on the wood surface of the face veneer layer 34 and in part also the adjacent base veneer layers 32 and pulls the latter, which have become slidable due to the partly liquefied phenolic resin in the phenolic resin film down towards the lower boundary edge of the cutout, so that there the face veneer layer 34 pressed down by the deformation pressure onto the face facing the surface 26 of the opposite tool 14 forms a sharp, hard boundary edge, which requires no further working, such as milling. The pulling action is sufficient to pull down the face veneer layer 34 to the lower boundary edge of the cutout facing surface 26 and thereby fully covering with face veneer the circumferential wall of the cutout, including the shaping or boundary edge. As the pulling action which can be achieved is limted, there are limits on this procedure as regards material thickness, namely at approximately 5 mm total thickness of the veneer workpiece to be produced. Rarely occurring small cracks are closed by the displacement pressure. As the lowering of the punching tool 12 onto the opposite tool 14 advances, the tools start to close, so that the pressing pressure exerted on the workpiece surfaces reaches its end point and the veneer layer system, in conjunction with the pressing temperature brings about the hardening of the phenolic resin, so that the firmly hardened veneer workpiece is produced.

There are virtually no limits as regards the size and shape of the cutouts to be produced. Cutout edges with both a larger and a smaller radius of curvature can be obtained. In the case of cambered parts, the underside can be pressd out flat, so that a bonding of the veneer workpiece without any special operation is possible.

The inventive features disclosed in the description, drawings and claims can be essential to the realization of the different embodiments of the invention, either singly, or in random combination.

I claim:

1. A process for producing a veneer workpiece including at least one base veneer layer, a cover veneer layer and a cutout passing through the base veneer layer and the cover veneer layer which comprises:

providing a stack of base veneer layer and cover veneer layer with an adhesive layer between said base veneer layer and said cover veneer layer, as a single step:

(a) applying sufficient pressure on said stack to adhere said base veneer layer and said cover veneer layer together, (b) punching said cutout through said stack and (c) lining the circumferential wall of said cutout with the cover veneer layer, said cover veneer layer being pressed through into said cutout up to the junction of said circumferential wall with the cutout edge which defines the opposite surface of the veneer workpiece.

2. Process according to claim 1, characterized in that the pressure punching process is performed at a temperature of approximately 140° C.

3. Process according to claim 1, characterized in that a phenolic resin film is used for adhering the veneer layers.

4. Process according to claim 1, characterized in that synthetic resin glue is used for adhering the veneer layers.

5. Process according to claim 1, characterized in that the compressing process is performed with a pressing pressure of approximately 10 kp/cm$^2$.

6. A pressure punching tool for simultaneously uniting an adhesive coated base veneer to a face veneer to form a veneer workpiece and forming a smoothly contoured cutout in the resulting workpiece comprising:

a punching tool body having at least one cutting edge with a displacement surface forming one face of said cutting edge and a shaping surface forming the other edge thereof; and a substantially planar tool body cooperating with said punching tool body to sever a cutout from said veneers while said veneers are confined between said tool bodies.

7. A pressure punching tool according to claim 6, wherein both said punching tool body and said planar tool body are heatable.

8. A pressure punching tool according to claim 6, wherein said planar tool is horizontal and stationary while said punching tool body is vertically movable with respect thereto.

9. A pressure punching tool according to claim 6, wherein said punching tool body includes a spacing surface for preventing contact between said cutting edge and the surface of said planar tool body.

10. A pressure punching tool according to claim 6, wherein said punching tool has a shaping edge adjacent to the edge of the veneer workpiece being compressed.

11. A pressure punching tool according to claim 10, wherein said shaping edge is rounded.

12. A pressure punching tool according to claim 10, wherein the distance between said shaping edge and the surface of said planar tool body in the closed state of said punching tool is greater than the distance between said cutting edge and the surface of said planar tool body.

* * * * *